US008550713B2

(12) United States Patent
Schwarz

(10) Patent No.: US 8,550,713 B2
(45) Date of Patent: Oct. 8, 2013

(54) BAG FOR HANDHELD ELECTRONIC DEVICE

(76) Inventor: Edward L. Schwarz, Minneapolis, MN (US)

( * ) Notice: Subject to any disclaimer, the term of this patent is extended or adjusted under 35 U.S.C. 154(b) by 451 days.

(21) Appl. No.: 12/507,189

(22) Filed: Jul. 22, 2009

(65) Prior Publication Data

US 2011/0019939 A1 Jan. 27, 2011

(51) Int. Cl.

| | |
|---|---|
| ***B65D 33/00*** | (2006.01) |
| ***B65D 33/24*** | (2006.01) |
| ***B65D 33/28*** | (2006.01) |
| ***B65D 33/04*** | (2006.01) |
| ***B65D 30/02*** | (2006.01) |

(52) U.S. Cl.

USPC ..... 383/35; 383/41; 383/43; 383/75; 383/106; 383/118

(58) Field of Classification Search

USPC ..... 383/35, 43, 75, 16, 106, 118, 74, 383/41

See application file for complete search history.

(56) References Cited

U.S. PATENT DOCUMENTS

| | | | | |
|---|---|---|---|---|
| D213,210 | S | 1/1969 | Correcia, Jr. | |
| D248,881 | S | 8/1978 | Goldfarb et al. | |
| 4,555,812 | A | 12/1985 | Akers | |
| 6,120,025 | A * | 9/2000 | Hughes, IV | 273/148 B |
| 6,655,543 | B2 * | 12/2003 | Beuke | 220/739 |
| 6,948,614 | B1 * | 9/2005 | Hall et al. | 206/305 |
| D533,342 | S | 12/2006 | Addis | |
| D553,351 | S | 10/2007 | Ballman et al. | |
| 7,344,308 | B2 * | 3/2008 | Meyer et al. | 383/41 |
| D575,055 | S | 8/2008 | Eisenbraun | |
| D578,534 | S | 10/2008 | Shi et al. | |
| D627,963 | S * | 11/2010 | Schwarz | D3/218 |
| 7,986,872 | B2 * | 7/2011 | Steiner et al. | 396/27 |
| 2005/0161352 | A1 * | 7/2005 | Huddleston | 206/320 |
| 2006/0072857 | A1 * | 4/2006 | Revels | 383/35 |
| 2008/0226206 | A1 * | 9/2008 | Mogi | 383/105 |
| 2009/0194444 | A1 * | 8/2009 | Jones | 206/320 |
| 2010/0096425 | A1 * | 4/2010 | Thistle | 224/600 |
| 2010/0147716 | A1 * | 6/2010 | Jones | 206/320 |

FOREIGN PATENT DOCUMENTS

JP 2008200459 A * 9/2008

OTHER PUBLICATIONS

Domo-kun, Wired Magazine, p. 067, Sep. 2009.

* cited by examiner

*Primary Examiner* — Jes F Pascua

(57) ABSTRACT

A bag for enclosing a handheld electronic device (HED) comprises a flexible sheet material such as a flexible or stretchy fabric. The material is formed into a bag having a main body and a mouth. The mouth has a periphery smaller than the periphery of the main body. The mouth can elastically stretch to allow passage of the HED. First and second loops are attached to and project from the bag adjacent to the mouth to allow a user to support the bag with thumb and forefinger while inserting the HED. In one embodiment, an elastic structure comprises the periphery of the mouth. The unstretched length of such an elastic structure may be adjusted to compensate for the size of the HED.

14 Claims, 1 Drawing Sheet

BAG FOR HANDHELD ELECTRONIC DEVICE

BACKGROUND OF THE INVENTION

Handheld electronic devices (HEDs) have become ubiquitous in the last few years. Cell phones are the most common of these of course, but PDAs, GPS units, and digital cameras are also found in frequent use.

As electronic devices, HEDs are inherently somewhat fragile. Mechanical shock, dust and dirt, and liquids can all damage these devices. Accordingly, protecting HEDs from these damage agents is important.

Although protecting HEDs from harm is important, it is also important that a person's individual HED be quickly accessible. These two requirements are not complementary. That is, the more accessible a HED is to its owner, typically the less well that HED is protected, and vice versa.

For cell phones, cell phone manufacturers now typically resolve these competing purposes with a belt case. These belt cases attach with a clip to the cell phone owner's belt. The cases have spring-loaded walls or a flap with a magnetic latch or hook and loop closure to retain the cell phone and yet allow reasonably convenient access to the cell phone.

Belt cases have a number of deficiencies. Belt clips may unexpectedly detach from the owner's belt creating the potential for the cell phone to fall to the ground perhaps damaging the cell phone. Or the owner may not securely insert the cell phone into the case, with the same result. Sometimes the owner may not secure the latch, so the cell phone falls out of the case later on.

And it's fair to say that a belt case is not a fashion statement. Because of that, women particularly, often keep their cell phones in their purses. Men on the other hand, may keep their cell phones in their pockets.

Both of these solutions have disadvantages. Carrying a cell phone in either a pocket or purse without a case can lead to damage to it. The jostling that a cell phone experiences in a pocket or purse can scratch or abrade the display. Even worse, pockets and purses are dirty, so that contamination makes the keys stick or cause imperfect contact by the switches the keys. Worst of all, particularly in purses, liquid spills are possible that can damage the cell phone.

A belt case is not a good holder for a cell phone to be carried in a pocket or purse. The clip is relatively bulky. Many cases expose the cell phone at a number of points to dirt, shock, and abrasion.

Bags or sleeves are available that solve this problem. These typically are made from a soft fabric thick enough to provide some shock and contamination protection. The bag has a drawstring opening that the owner can close to protect the cell phone. While such a bag provides quite good protection for the cell phone, users find the acts of inserting and removing the cell phone from the bag time-consuming.

Thus, the current state of the art provides some solutions to the twin problems of both protecting a cell phone from damage and also allowing relatively easy access to the cell phone or other HED. But each solution has at least some flaws.

BRIEF DESCRIPTION OF THE INVENTION

A bag for enclosing a handheld electronic device (HED) comprises a flexible sheet material such as a flexible or stretchy fabric. The material is formed into a bag having a main body and a mouth sized to accommodate an HED. The mouth has a periphery smaller than the periphery of the main body. The mouth can elastically stretch to allow passage of the HED.

First and second loops are attached to and project from the bag adjacent to the mouth to allow a user to support the bag with thumb and forefinger while inserting the HED into the bag. In one embodiment, an elastic structure encircles at least a portion of the periphery of the mouth. The unstretched length of such an elastic structure may be adjusted to compensate for the size of the HED. When properly adjusted, the weight of the HED is insufficient to cause the HED to slip from the bag.

DESCRIPTION OF THE PREFERRED EMBODIMENTS

Figure 1:
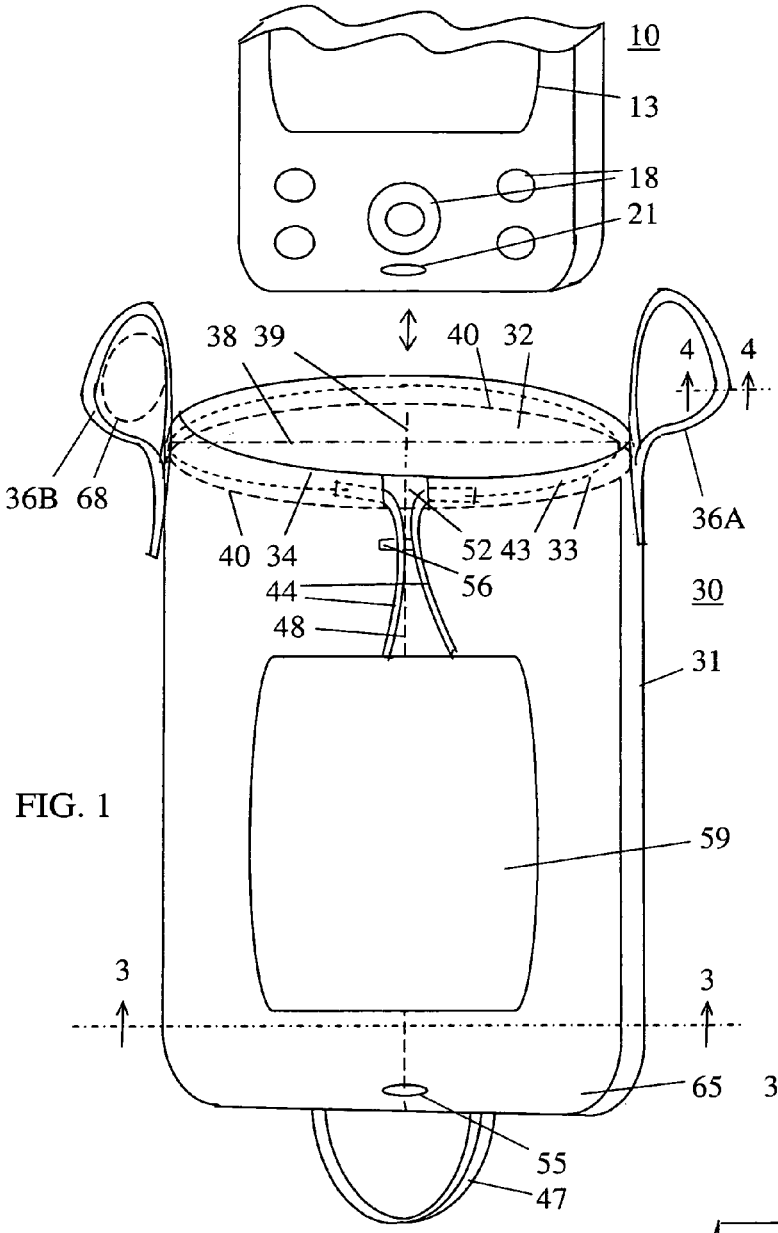
FIG. 1 is a perspective view of a HED bag comprising a form of the invention particularly suitable for holding a cell phone.

FIG. 1 shows a HED bag 30 suitable for holding a HED 10. FIG. 1 shows the HED 10 itself as a cell phone 10. Cell phone 10 has a screen 13, earpiece slot (not shown), microphone slot 21, and a number of control buttons 18. Control buttons 18 have a wide variety of formats depending on the particular type of cell phone involved.

Figure 5:
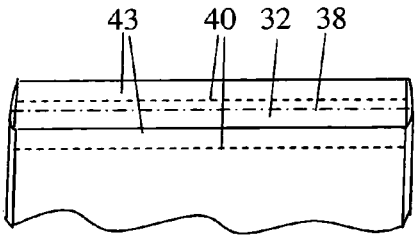
FIG. 5 shows an HED bag mouth having an elongate rectangular shape.

Bag 30 has a main body 31 having a bottom 65. Body 31 has a mouth 32 with a periphery 34. The shape of mouth 32 is an oval (FIG. 1) or an elongate rectangle (FIG. 5) to accommodate the normal cross section of a cell phone 10 or other HED. Mouth 32 has a long or major axis 38 more or less horizontal as shown in FIG. 1 and FIG. 5. A short or minor axis 39 of mouth 32 is perpendicular to the major axis 38 and to the vertical axis of bag 30. The unstressed circumferential length of periphery 34 is smaller than the rest of main body 31.

Body 31 comprises a thin, flexible, sheet material such as sheet plastic, cloth, or fabric. Preferably bag 30 comprises at least in part a type of flexible woven or knit fabric that has a small amount of inherent elasticity or stretchiness. The fabric comprising bag 30 preferably has nap with good frictional characteristics to limit the possibility that a person may inadvertently allow bag 30 to slip from the person's grasp. Stitching 48

A certain level of liquid repellence for the fabric forming bag 30 is also advantageous. The bag 30 fabric preferably also has some compression resilience to provide cushioning and protection against shock. In point of fact, cushioning is probably the preferable characteristic if fabrics providing both liquid repellence and cushioning are not feasible, for example because of excessive stiffness or cost. If bag 31 is sewn into the shape shown in FIG. 1, the material should be one that needle punctures do not excessively weaken.

The elasticity of the fabric forming body 31 may be similar to that of various storage bags now available for various types of electronic equipment, say 5-20% elongation for a 1 in. wide strip under a 1 lb. load. The body 31 material may be relatively soft and approximately 0.02-0.08 in thickness when not compressed. Body 31 may also have a double wall construction, with a thin layer or sheet of insulation such as foam between the walls to provide cushioning of a HED for at least short drops onto somewhat resilient surfaces such as rugs. Since bag 30 is to fit easily within a pants pocket, purse, or other small storage space while holding a HED 10, all of its components should in any case be relatively thin and flexible.

Figure 3:
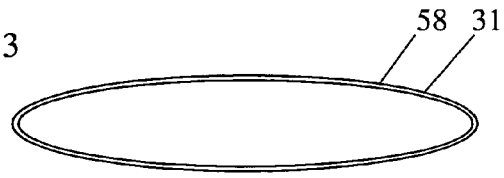
FIG. 3 is a cross section of the bag showing its general shape.

Bottom 65 has a semi-rectangular or ellipsoidal cross sectional shape, which gives the entire body 31 a similar shape. FIG. 3 shows the general shape of the body 31 cross section. Understand that bag 30 is made from flexible material that easily folds and molds to the shape of a cell phone 10 that bag 30 holds, so this view is no more than suggestive of the bag 30 shape.

FIG. 3 also shows alternate structure for the body 31 material. The form of this material may comprise two layers of material as shown for added padding. A thin layer of foam 58 may be sandwiched between two layers of material for still more padding.

First and second finger loops 36A and 36B attach to body 31 near, in the vicinity of, or at the periphery 34 of mouth 32 and preferably near the ends of major axis 38 to form an important feature of bag 30. Loops 36A and 36B may comprise thin, somewhat flexible strip or band material or a heavy cord. The material forming loops 36A and 36B preferably has a small amount of stiffness for reasons to be explained.

Loops 36A and 36B each may each have a peripheral (circumferential) length of at least approximately 1.5 in. (4 cm.) and preferably at least 2-2.5 in. (5-6 cm.). The size of each loop 55A and 55B should be sufficient to allow a typical user's forefinger or thumb (shown symbolically by the outline 68) to easily enter each of the loops 55A and 55B. Loops 36A and 36B improve the user's ability to insert a cell phone 10 into bag 30.

The specified small amount of stiffness in the loops 36A and 36B material helps to hold loops 36A and 36B open, and approximately in the plane of the paper. The stiffness of the loop 36A and 36B material preferably holds the loops 36A and 36B vertically upright with only minimum sagging from an open, upright shape. This construction for loops 36A and 36B allows a user's thumb and forefinger to more easily enter loops 36A and 36B. The stiffness of loops 36A and 36B should not be so great as to interfere with pocketing bag 30 with a cell phone 10 in it.

Figure 4:
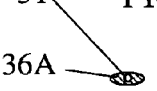
FIG. 4 is a cross section of one finger loop.

The cross section of FIG. 4 shows an embodiment of the loop 36A material that includes a fine plastic or woven metal stiffening center 51 extending through the entire length of loop 36A that stiffens loop 36A sufficiently to hold loop 36A in the open, projecting shape that FIG. 1 shows. Loop 36B may have a similar construction. Loops 36A and 36B material may also comprise relatively stiff, tightly woven threads or have some sort of impregnation to provide the desired stiffness.

Bag 31 may further include a removal tab 47 that may be in the form of a loop attached at a point remote from mouth 32. The user can pull on tab 47 when removing cell phone 10 from bag 30. Tab 47 need not have any stiffening center.

Bag 30 may also include a flexible transparent window 59 that allows the user to view screen 13. Openings 55 and 56 below and above window 59 may be present with positions that align with the earpiece and microphone 21 respectively of cell phone 10 to allow cell phone 10 use while in bag 30. Opening 55 may be placed between mouth 32 and window 59 and adjacent to mouth 32.

Typical cell phones 10 may be approximately 3.5-4.5 in. tall, 2-3 in. wide, and 0.5-0.75 in. thick. Approximate dimensions for a bag 30 for such a cell phone 10 may be: height 4.5-6 in. and width 3-4 in. These dimensions are with the bag 30 lying empty on a flat surface.

One preferred embodiment for bag 30 has a mouth 32 having an elastic periphery 34 whose unstressed peripheral length is perhaps 5-20% smaller than the peripheral length of the cell phone 10 cross section perpendicular to the long dimension. This smaller, elastic periphery 34 of mouth 32 prevents the cell phone 10 from falling out of bag 30 if the user fails to grip bag 30 tightly enough.

The elastic periphery 34 may be formed simply by inherent elasticity of the body 31 material, and by constructing body 31 with a restricted peripheral dimension at the mouth 32 as FIG. 1 shows. In this design, a bag 30 will likely be compatible only for a relatively small range of cell phone 10 sizes.

FIG. 1 shows a design for bag 30 that is compatible with a wider range of cell phone 10 sizes. Periphery 34 includes a tunnel or passage portion 43 passing around at least a portion of periphery 34. In FIG. 1, tunnel 43 extends around nearly the entire periphery 34. Tunnel 43 may have an interruption or access space 52. Tunnel 43 may be conveniently formed by stitching 40.

Figure 2:
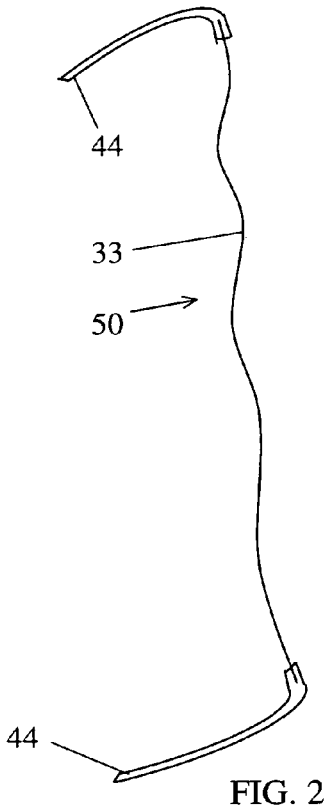
FIG. 2 is a elevation view of an elastic structure for providing elastic closure for the HED bag.

FIG. 2 shows an elastic cord structure 50 that fits within tunnel 43. Cord structure 50 includes an elastic band 33 that when unstressed preferably extends through only a portion of tunnel 43. Elastic band 33 may comprise an elastic strip or thread. Band 33 may have a coefficient of elasticity of a few ounces of force per inch of elongation.

Preferably, the unstressed length of structure 50 is adjustable. To provide adjustability, this embodiment of cord structure 50 includes a length adjustment feature comprising ties 44 attached to band 33. Ties 44 are substantially less elastic than band 33. By tying ties 44 together at various points on them to form a knot, a user can vary the effective unstressed length of structure 50 within tunnel 43, and thereby adjust the force required to expand mouth 32 to allow cell phone 10 to pass therethrough. Other ways of adjusting the effective unstressed length of structure 50 are possible as well, and are included in the definition of "length adjustment feature."

Structure 50 fits within tunnel 43 with ties 44 projecting from interruption 52. By tying ties 44 to each other, a user can adjust the overall length of structure 50 when unstretched to accommodate a range of cell phone 10 peripheral sizes. This allows the user to select the amount of force required to expand mouth 32 to a size allowing cell phone 10 to enter and exit bag 30.

When bag 30 is suspended by tab 47 with a cell phone 10 within, the tension in periphery 34 should be sufficient to prevent cell phone 10 from falling through mouth 32 under the weight of cell phone 10 only. In fact, a gentle shake of bag 30 by tab 47 should not allow cell phone 10 to fall from bag 30. The amount of retention force depends on the tension in periphery 34 when stretched almost to the size of cell phone 10.

Upon first acquiring a bag 30, the user will tie ties 44 together so that the overall unstretched periphery of the bag 30 mouth is slightly smaller than the periphery of the cell phone 10 cross section perpendicular to the long dimension. The force required to remove cell phone 10 should be slightly greater than the weight of cell phone 10, to thereby prevent cell phone 10 from inadvertently slipping from bag 30. A user may want to experiment with the proper total length of structure 50 within tunnel 43 to maximize convenience. The user can tie structure 50 at several different lengths until the tension in periphery 34 is acceptable to the user. Once achieving that tension, the user can simply cut off the excess length of ties. 44.

If a bag 30 is designed for a specific cell phone 30 housing size, structure 50 may be unnecessary, or can be preset as to tension during manufacture.

A user inserts a cell phone 10 into bag 30 by placing thumb and forefinger into loops 36A and 36B respectively. With the other hand, the user presses first one lower corner of the cell phone 10 into mouth 32 to stretch mouth 32 and structure 50 if present between the cell phone 10 corner and the opposite one of loops 36A and 36B. Then the user forces the other corner of cell phone 10 into the mouth of bag 30, whereupon cell phone 10 slides easily and completely into bag 30. The inherent stiffness of the loop 36A and 36B material makes it relatively easy for the user to insert his or her fingers into loops 36A and 36B. Surprisingly, users with a wide range of hand sizes can insert a cell phone into bag 30 with little trouble.

To remove cell phone 10 from bag 30, the user grasps tab 47 with one hand and cell phone 10 with the other, and simply pulls the cell phone 10 from bag 30.

Cell phones are by nature relatively slippery. The nap and friction between a user's fingers and the material comprising bag 30 reduces the likelihood that a cell phone 10 or bag 30 will inadvertently slip from a user's fingers.

One preferred form for the fabric piece forming bag 30 is a simple rectangular piece of fabric perhaps 7-8 in. (height dimension)×8 in. (width dimension). Tunnel 43 is first sewn with stitching 40, with structure 50 within. Then loops 36A and 36B are sewn onto the fabric piece, which is then folded along the height dimension. The bottom and side is sewn, and then the bag 30 is turned inside out to complete bag 30 and provide a finished look. Stitches 48 form a part of the bag 30 construction. Stitching may alternatively be along a side of body 31 rather than extend in the center as stitches 48 do.

What I claim is:

1. A bag for enclosing a handheld electronic device (HED), the construction of said bag facilitating insertion of the HED by a person into the bag, said bag comprising:

a) a flexible sheet material formed into a bag having a main body and a mouth, said mouth having an internal periphery smaller than the internal periphery of the main body, and said mouth elastically stretching to allow passage of the HED, wherein the mouth has one of a substantially oval shape and a substantially elongate rectangular shape to accommodate the normal cross section of a HED, said mouth having a major axis extending along a long dimension of the mouth; and b) first and second finger loops attached to the bag at substantially the ends of the major axis thereof wherein the finger loops have stiffness adequate to support the loops in an open, projecting shape.

2. The bag of claim 1, including an elastic band at least partially encircling the mouth.

3. The bag of claim 2, including a tunnel in the flexible sheet material adjacent to and surrounding the mouth, and within the tunnel, the elastic band.

4. The bag of claim 3, including an interruption in the flexible sheet material defining the tunnel, and including first and second substantially inelastic ties attached to first and second ends of the elastic band and projecting from the interruption.

5. The bag of claim 4, including a tab attached to the main body at a point remote from the mouth, said tab for assisting removal of a HED from the bag.

6. The bag of claim 5, wherein the finger loops are attached to the mouth's periphery and project from the bag.

7. The bag of claim 6, wherein the tab attached to the main body at a point remote from the mouth comprises a loop substantially centrally located from the sides of the main body.

8. The bag of claim 2, wherein the sheet material comprises a fabric with inherent elasticity.

9. The bag of claim 2 wherein the finger loops have a circumferential length of approximately 1.5-2.5 in.

10. The bag of claim 2 wherein the elastic band includes a length adjustment feature comprising substantially inelastic ties attached to first and second ends of the elastic band.

11. The bag of claim 1, wherein a portion of the main body comprises flexible, transparent material forming a window for viewing a screen of a HED.

12. The bag of claim 11, wherein the main body has an opening between the mouth and the window and adjacent to the mouth for at least one of an earpiece and a microphone.

13. The bag of claim 1, wherein the sheet material comprises a fabric with inherent elasticity.

14. The bag of claim 1, wherein at least one of the first and second finger loops comprises material have a stiffening center extending through at least a part of the finger loop.

* * * * *